United States Patent [19]

van Weert

[11] 4,398,548

[45] Aug. 16, 1983

[54] METHOD AND APPARATUS FOR MOISTENING BUNDLES OF FLEXIBLE MATERIAL IN PARTICULAR BUNDLES OF TOBACCO LEAVES

[75] Inventor: Cornelis J. M. van Weert, Valkenswaard, Netherlands

[73] Assignee: Machinefabriek Wegra B.V., Valkenswaard, Netherlands

[21] Appl. No.: 205,248

[22] Filed: Nov. 10, 1980

[51] Int. Cl.[3] ..... A24B 3/18; A24B 3/04

[52] U.S. Cl. ..... 131/304; 131/306

[58] Field of Search ..... 131/290, 300, 302, 303, 131/304, 306; 68/5 R, 5 A, 5 B, 5 C; 134/132, 134, 153

[56] References Cited

U.S. PATENT DOCUMENTS

| | | | |
|---|---|---|---|
| 2,280,705 | 4/1942 | Hurxthal | 131/306 |
| 3,280,825 | 10/1966 | Rosing | 131/304 |
| 3,447,505 | 6/1969 | Wagner | 134/123 |

FOREIGN PATENT DOCUMENTS

| | | |
|---|---|---|
| 646155 | 3/1936 | Fed. Rep. of Germany . |
| 1269186 | 6/1960 | France . |
| 35798 | 2/1935 | Netherlands . |
| 7113159 | 4/1972 | Netherlands . |
| 375036 | 6/1932 | United Kingdom . |

*Primary Examiner*—Millin, V.

*Attorney, Agent, or Firm*—Hammond & Littell, Weissenberger and Muserlian

[57] ABSTRACT

The present invention relates to a method and apparatus for moistening tobacco leaves (31) by passing bundles of leaves (31) through a space (7) containing atomized water which bundles according to the invention are passed through said space (7) while being suspended from the base thereof with the leaves hanging downwardly which bundles to this end are clamped with the base of the bundle in spaced apart clamping means (8) which are freely rotatably connected to an endless conveyor chain (2) said clamping means (8) during their passage through the said moisture containing space (7) are rotated by frictional engagement with one or more endless belts (11,11') while the nozzles (21,22) which atomize the water create turbulence in said space (7).

6 Claims, 3 Drawing Figures

Figure 1:
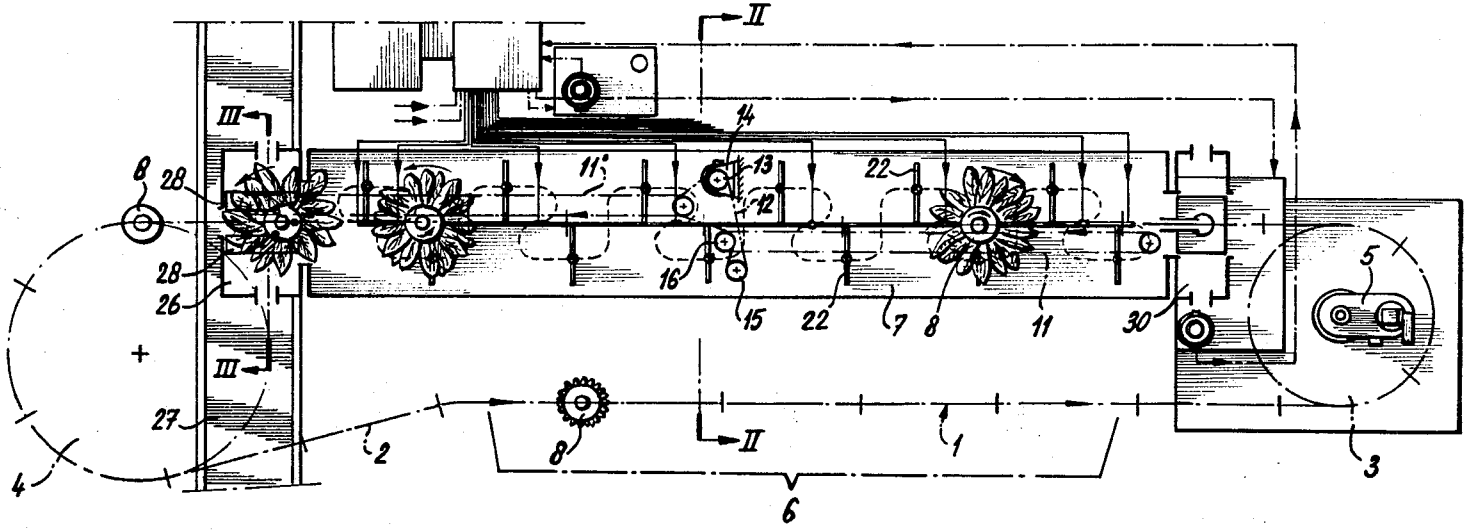

METHOD AND APPARATUS FOR MOISTENING BUNDLES OF FLEXIBLE MATERIAL IN PARTICULAR BUNDLES OF TOBACCO LEAVES

The invention relates to a method of moistening bundles of flexible material, in particular bundles of tobacco leaves, by placing the bundles at the base thereof into a clamping means and passing the same through a space in which there is atomized a liquid, such as water. Such a method is known. According to said known method the bundles are placed in upright position into a clamp and are passed through a space in which water is sprayed onto the bundles. This treatment is effected because a certain moisture content is necessary in order to avoid pulverisation in particular during the subsequent working up thereof. Tobacco leaves may have a very different structure and accordingly it is of utmost importance that the proper amount of moisture is applied in such a manner that distribution thereof will be uniform and in the proper amount everywhere.

Tobacco leaves are supplied in bundles the stalk ends of which are tied together by means of a tobacco leave or rush. Previously it was known to remove this tie and to moisten the leaves separated from each other within a drum. This method is complicated and time consuming.

However in the above described known method in which bundles are placed in upright position there is the drawback that the leaves fall down and remain in lying position. Upon falling down the leaves of the bundle will cover each other thus inhibiting a uniform moistening.

The object of the invention is to provide a method and an apparatus not subject to said drawbacks.

This object is achieved in accordance with the invention in that the bundles are passed through said space while being suspended from the base thereof and being rotated about the axis of said base. Where the bundles hang downwards the rotation will force the leaves to move apart while the leave assume a more or less slanting fanning position according to the number of revolutions. Where leaves cannot fall flat said leaves will remain loose from each other and will moreover be subject to a mutual movement resembling a flitting motion due to the movement in the air during the rotation.

This effect may yet be enhanced if during the passage through the moistening space the direction of rotation is altered one or more times. Upon alteration of the direction of rotation the bundle of leaves will assume each time a limply drooping position before being fanned out again when the rotation in the opposite direction is restarted.

Preferably the air within a the moistening space is kept yet also in turbulent motion, it being preferred to impart this turbulent motion to the air by means of air jets for atomizing the liquid.

An optimum effect is attained when instead of a moistening by means of thin water jets there is utilized in accordance with the invention a fine atomization by atomizing the water by means of air jets whereby the current of air laden with fine water droplets may reach the rotating bundles of leaves from all sides while said current of air per se provides for moving the leaves apart from each other.

The invention furthermore relates to an apparatus for carrying out the above described methods, said apparatus comprising first of all an endless conveyor guide and a conveyor chain guided therein, said conveyor chain being provided with a plurality of mutually spaced clamping or holding means for clamping or holding, respectively, the bundles to be treated, said clamping or holding means being fastened to said chain in downwards hanging position and operable to be rotated about a vertical axis, said chain passing consecutively through an insert station, a moistening space and a discharge station. The rotary movement of the clamping or holding means may be brought about in several ways.

However according to the invention this may be realized in a simple manner by suspending said clamping means in a freely rotatable manner and providing the same with a cylindrically curved surface coaxially with respect to the axis of rotation and by providing an endless belt operative to be driven and extending parallel to the direction of conveyance in said moistening space, said belt being operable to engage said cylindrically curved surface. Hence upon entering the moistening space the holding or clamping means will immediately engage a driven belt, whereby said clamping or holding means are set in rotation causing the leaves to fan out. By utilizing several belts operable to impart an opposite direction of rotation to the holding or clamping means, the bundles may be rotated consecutively in the one direction and after a short interruption accompanied by a stand still of the leaves in the other direction.

For enhancing the feeding operation of the apparatus it is preferred to use clamping means of a type that automatically closes upon insertion of a bundle. In principle several constructions are conceivable for attaining such object. At the location of the discharge station there may then be provided means causing the release of the clamping means.

The atomizers may be provided in th bottom part and the top part of the moistening space, it being preferred in accordance with the invention to make provisions that the atomizers in the bottom part of the moistening space are adjustable in vertical sense in order to adapt the position there of to the size of the leaves.

Preferably the clamping or holding means are rotatably supported in sealing plates connected to each other to form a chain, said sealing plates being accommodated between the driving cylinder and the clamping means per se and being operative to be guided on the side walls of the guide slot present in the top part of said moistening space. in this way there is achieved not only a sealing of the conveying means and the guiding means with respect to the humid environment in the moistening space but also a guide providing for a stable conveyance through the moistening space in spite of the inavoidable unbalance during the rotation.

Figure 2:
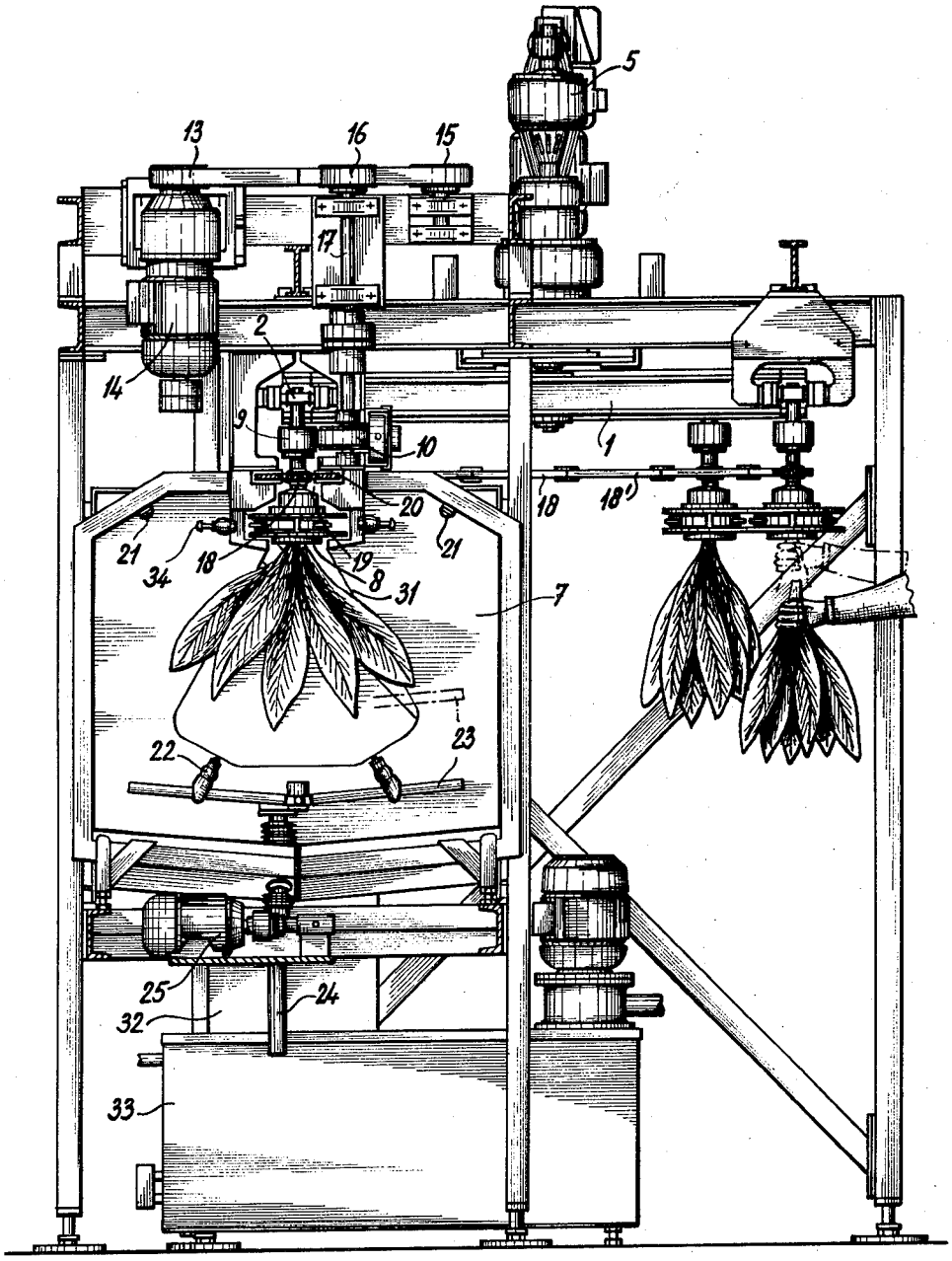
Figure 3:
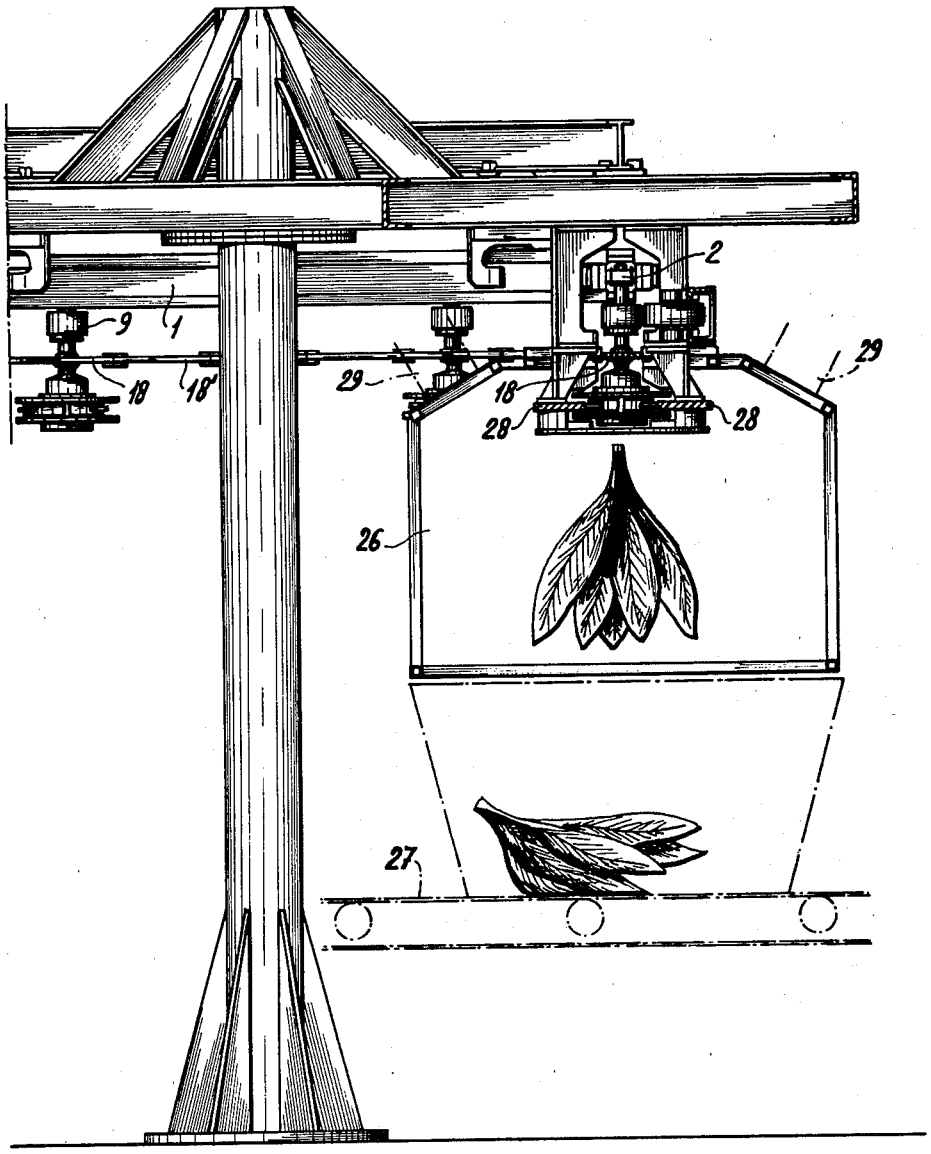

The invention will now be elucidated in further detail with reference to the drawings, in which FIG. 1 diagrammatically shows a plan view of the apparatus according to the invention, FIG. 2 is a cross section along the line II—II in FIG. 1, and FIG. 3 is a cross section along the line III—III in FIG. 1.

In FIG. 1 the reference numeral 1 indicates the path of an endless conveyor guide in which there is accommodated a conveyor chain 2. This chain runs over reversing sprockets 3 and 4 which have been represented diagrammatically only and of which the sprocket 3 is connected to a drive mechanism 5.

This conveyor guide follows an elongated path having two straight parts one of which runs through a moistening space 7.

Clamping means 8 spaced apart with respect to each other are suspended from the chain. These clamping means are suspended from the chains in a freely rotatable manner and have been provided with a cylindrically curved driving surface 9. The clamping means are provided with operating means 10 by means of which the spring pressurized not shown clamping jaws may be opened.

With reference to FIG. 2 there is shown in the right hand part the insertion operation performed within the region 6 (FIG. 1).

In the moistening space 7 there are accommodated two driving belts 11 and 11' which run parallel to the direction of conveyance and which may come into frictional engagement with the cylindrically curved driving surface 9 of the clamping or holding means 8. The belt 11 will force the holding means to rotate to the right and the belt 11' to the left. At the location of the reversing wheels thereof said belts are both driven by a belt 12 running over rollers mounted on the shafts of the reversing wheels, a drive roller 13 on the shaft of a motor 14 and a tensioning roller 15.

With reference to FIG. 2 there is shown how a driving roller 16 drives the belt 11 by way of the shaft 17, said belt 11 engaging the cylindrical surface 9 of the clamping means 8, which clamping means is suspended from the chain 2 and is operative to be rotated by means of a not shown bearing present above the cylinder 9. By means of a not shown bearing each clamping means is furthermore rotatably mounted in a sealing plate 18; a chain being formed by said sealing plate 18 together with corresponding sealing plates 18'.

With reference to FIGS. 2 and 3 it is shown that this chain is guided in a sealing manner through the guide slot 19 of the moistening space 7 made in the form of a box in which the sealing plates 18 are in contact with anti-friction plates 20 inserted in the side wall portion of the guide slot.

Thereby the moistening space 7 is closed moisture tight to the top thereof, while moreover a stabilization is achieved so that the clamping means will not be able to acquire an oscillating motion under the influence of the unbalance caused by the bundles of leaves. Furthermore the proper engagement with the driving belt will be assured thereby.

With reference to FIG. 2 it is shown that in the wall at the top of the space 7 there are provided compressed air operated atomizers 21 for atomizing water. Furthermore in the bottom part of the space there are provided atomizers 22 distributed, like shown in FIG. 1 in the longitudinal direction which atomizers 22 are mounted on a frame 23 which is adjustable in the direction of the height thereof. This adjustment is performed by means of screw spindles 24 and a drive mechanism 25. The adjustment is made between the lowermost position drawn in full lines and the uppermost position 23' shown in interrupted lines.

The moistening space is joined to the discharge station 26 accommodated above a transverse conveyor 27. The driving belt 11' extends into this discharge station at which there are provided two guide bars 28 which will engage the operating means 10 projecting at both sides thereof whereby also due to the rotation the clamping means is opened so that the moistened bundle will drop down therefrom.

If the clamping means is of the type that is self locking in the open position the clamping means will move in opened position to the insert station 6. If such is not the case, the opening of the clamping means at this insert station will have to be brought about in an other way.

Furthermore the discharge station 26 is provided with an exhaust 29 for exhausting moisture emanating from the moistening space.

At the location of the entrance of the moistening space 7 a similar exhaustor 30 may be provided.

The entrance and exit of the moistening space may be adapted to the shape of the bundle like indicated by the line 31 in FIG. 2.

By utilizing the apparatus according to the invention it becomes feasible to adapt the throughput and the speed of rotation by adjustment of the number of revolutions of the drive motors independently to the degree of moistening which is desired to be achieved and which is dependent on the kind of tobacco to be treated. The atomized sprays emanating from the nozzles enhance the separation of the leaves so that the moisture may penetrate well and uniformly everywhere.

The moisture leaving the moistening space 7 may be collected in a filter box 32 arranged therebelow and, if desired, may be returned to the liquid supply vessel 33.

At 34 there are provided atomizers by means of which the part of the bundle inserted in the clamping means may be moistened.

I claim:

1. A method of moistening bundles of leafy vegetation by placing the bundles at the base thereof into a clamping means and passing the same through a moistening space in which there is atomized a liquid, characterized in that said bundles are passed through said space while being suspended from the base thereof and being rotated about the vertical axis of said base.

2. The method according to claim 1, characterized in that during the passage through said moistening space the direction of rotation is altered.

3. The method according to claim 1 or 2, characterized in that a turbulent motion is imparted to the air within said moistening space.

4. The method according to claim 3 characterized in that the turbulent motion is imparted to the air by means of air jets for atomizing the liquid.

5. The method of claim 1 wherein the leafy vegetation is tobacco leaves.

6. The method of claim 1 or 5 wherein the liquid is water.

* * * * *